US005568776A

United States Patent [19]

Suraniti et al.

[11] Patent Number: 5,568,776

[45] Date of Patent: Oct. 29, 1996

[54] FLUIDIZED BED HEARTH FLOOR

[75] Inventors: Sylvestre Suraniti, Paris; Jean-Xavier Morin, Neuville Aux Bois; Frédéric Maillot, Clamart, all of France

[73] Assignee: GEC Alsthom Stein Industrie, Velizy-Villacoublay, France

[21] Appl. No.: 477,236

[22] Filed: Jun. 7, 1995

[30] Foreign Application Priority Data

Jun. 13, 1994 [FR] France ..... 94 07184

[51] Int. Cl.[6] ..... F23G 5/00

[52] U.S. Cl. ..... 110/245; 432/58; 422/143; 422/311

[58] Field of Search ..... 110/245; 432/58; 34/582; 431/179, 7; 422/143, 311

[56] References Cited

U.S. PATENT DOCUMENTS 4,257,757 3/1981 Ashe et al. ..... 431/7
4,312,135 1/1982 Devanney, III ..... 432/58
5,161,471 11/1992 Piekos ..... 110/245

FOREIGN PATENT DOCUMENTS

1442760B2 12/1968 Germany .
1367791 9/1974 United Kingdom .
201203 7/1979 United Kingdom .

*Primary Examiner*—Noah P. Kamen
*Attorney, Agent, or Firm*—Sughrue, Mion, Zinn, Macpeak & Seas

[57] ABSTRACT

A fluidized bed hearth floor comprises a supporting metal sheet provided with fluidization-gas injection nozzles. The supporting sheet is made of refractory metal, and is covered with a plurality of flat elements made of refractory metal, each flat element being fixed to the supporting sheet by welding in a localized zone, e.g., substantially at a point.

9 Claims, 2 Drawing Sheets

FLUIDIZED BED HEARTH FLOOR

FIELD OF THE INVENTION

The present invention relates to a fluidized bed hearth floor.

More precisely, it concerns a fluidized bed hearth floor comprising a supporting metal sheet provided with through fluidization-gas injection nozzles and coated with a coating of refractory material.

BACKGROUND OF THE INVENTION

In this zone of the hearth, the fluidized solids subject the coating to high levels of stress by erosion because of the high speeds imparted to them by the fluidization gas being ejected. Moreover, because of the large temperature differences between the inside of the hearth and the fluidization gas at the outputs of the injection nozzles via which the gas is injected, this zone of the hearth is subjected to high levels of thermal stress.

It is known that the supporting sheet can be protected by a layer of refractory material of the refractory concrete type.

Such a layer must be very thick, i.e. greater than 100 mm. That thickness increases both the total height of the furnace, and also the lengths of the feed means for feeding the fluidization nozzles.

Such a layer is also subjected to continuous wear and tear which makes it necessary for periodic repair work to be performed. At floor level in the hearth, the concentration of solids is very high, i.e. in the approximate range 500 kg/m$^3$ to 1,200 kg/m$^3$.

Furthermore, with wear, chips of the layer come away and mix in with fluidized combustion solids, thereby disturbing fluidization.

OBJECTS AND SUMMARY OF THE INVENTION

The present invention solves those problems by providing that the supporting sheet is made of refractory metal, and the coating is made up of a plurality of flat elements made of refractory metal and covering said supporting sheet, each flat element being fixed to the supporting sheet by being welded in a localized zone, e.g., substantially at a point.

The resulting coating protects the supporting sheet so that it is capable of withstanding heat, erosion, and thermal shocks. By being welded in a localized zone substantially at a point, it is possible for each of the flat elements to deform freely so as to allow for differential expansion. In this way, they are not stressed by forces that might tend to damage them.

Preferably, the flat elements are disposed adjacent to one another.

In a preferred embodiment, each flat element is provided with an opening in which the weld is performed that bonds it to the supporting sheet.

Advantageously, the opening is situated substantially at the center of the flat element.

The flat elements may be substantially rectangular. The nozzles may be disposed in rows and columns extending in the two directions of the supporting sheet, and they may be situated at the corners of the flat elements, which corners are scalloped. Both the supporting sheet and the flat elements are preferably made of refractory steel.

BRIEF DESCRIPTION OF THE DRAWINGS

A preferred embodiment of the present invention is described below in more detail with reference to the accompanying drawings, in which.

MORE DETAILED DESCRIPTION

Figure 1:
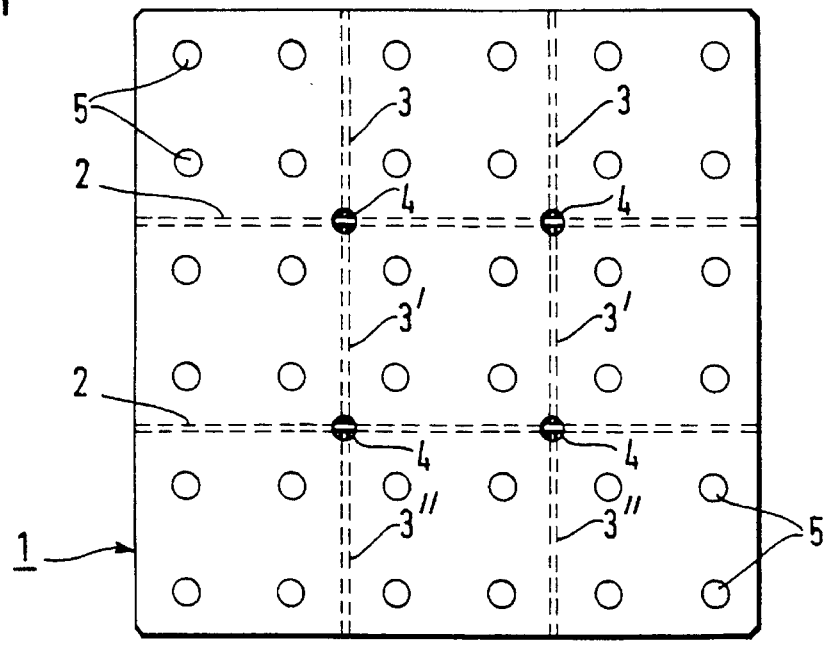
FIG. 1 is a plan view of the supporting sheet of the floor of a fluidized bed hearth.

FIG. 1 shows the supporting metal sheet 1 of the floor of the hearth, which sheet is made of a refractory metal, and preferably a refractory steel such as "Incoloy 800 HT". The sheet 1 is reinforced by stiffening means constituted by cross-pieces welded discontinuously under the sheet 1, e.g. by two continuous cross-pieces 2 and by two perpendicular stiffeners made up of cross-piece segments 3, 3', 3" disposed so that they form a grid with the continuous cross-pieces. Vertically above each intersection of the grid, the sheet 1 is provided with an opening 4 enabling the hearth floor to be assembled on site as described below.

Figure 2:
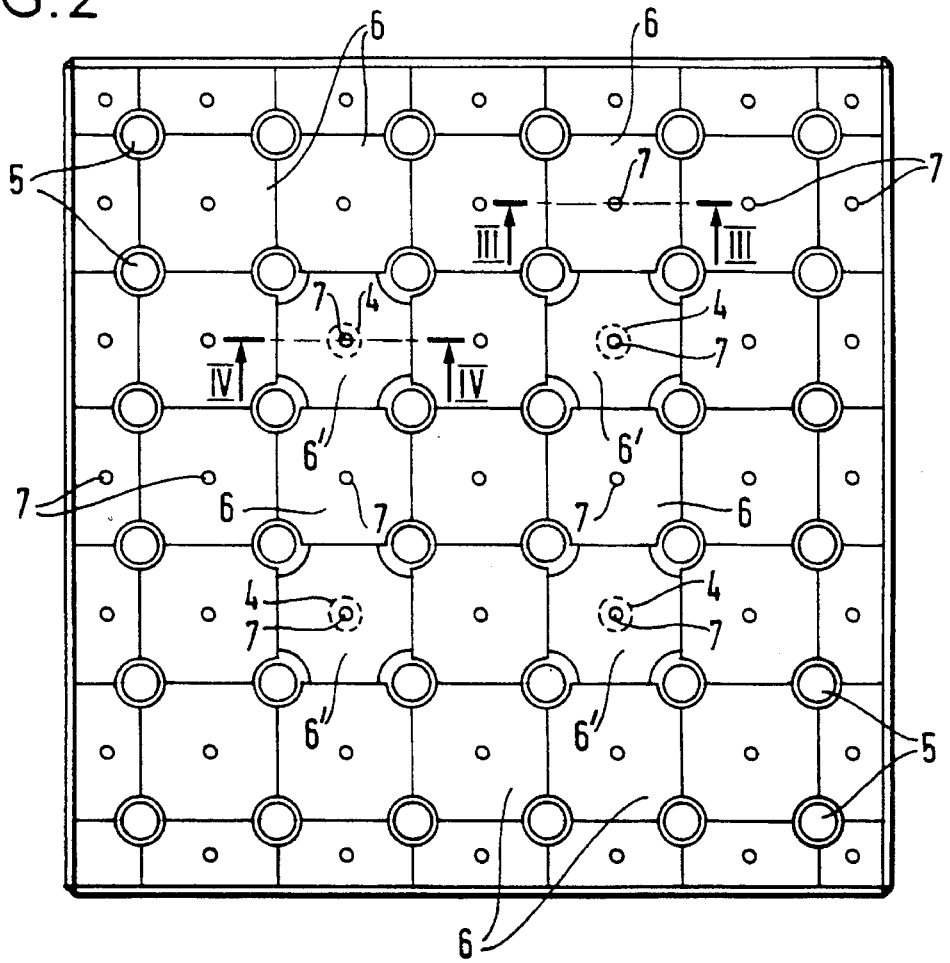
FIG. 2 is a plan view of the floor as provided with a coating in compliance with the invention.
Figure 5:
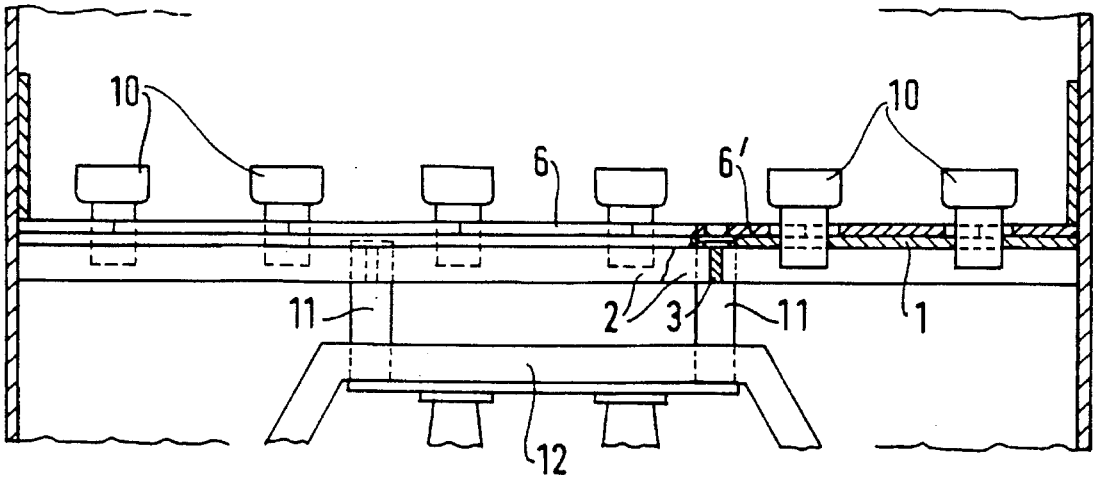
FIG. 5 is a vertical section of the floor as provided with the coating in compliance with the invention.

The sheet 1 is provided with through holes 5, for accommodating the feed pipes to the fluidization gas injection nozzles 10, as shown in FIGS. 2 and 5. Through holes 5 are disposed in rows and columns extending in the two directions of the supporting sheet 1 in a uniform grid. Advantageously, each one of openings 4 in the supporting sheet 1 is disposed equidistant from four through holes 5 for the nozzles 10.

A plurality of flat elements 6 that are 15 mm thick and that are made of a refractory metal, preferably a refractory steel such as "Incoloy 800 HT", are disposed adjacent to one another and cover the supporting sheet 1, each flat element 6 being fixed to the supporting sheet by being welded in a localized zone, e.g., substantially at a point. Most of the flat elements 6 are square with sides that are substantially equal to the distance between nozzles 10, rectangular flat elements 6 being provided along the edges of the sheet 1.

Each flat element 6 is provided with an opening 7 situated substantially at the center of the flat element 6 and in which the weld 8 is performed. Advantageously, the weld is a weld commonly referred to as a plug weld made up of a weld fillet extending around the edge of the opening 7 and connecting the flat element 6 to the supporting sheet 1. The corners of the flat elements 6 are scalloped so as to surround the through holes 5.

Figure 3:
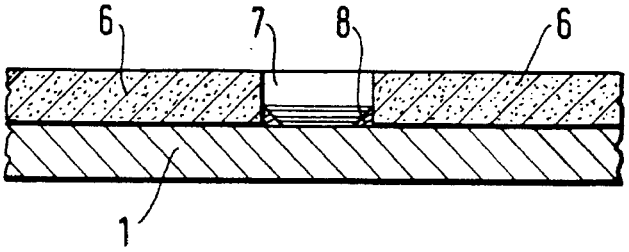
FIG. 3 is a vertical section view on III—III shown in FIG. 1.
Figure 4:
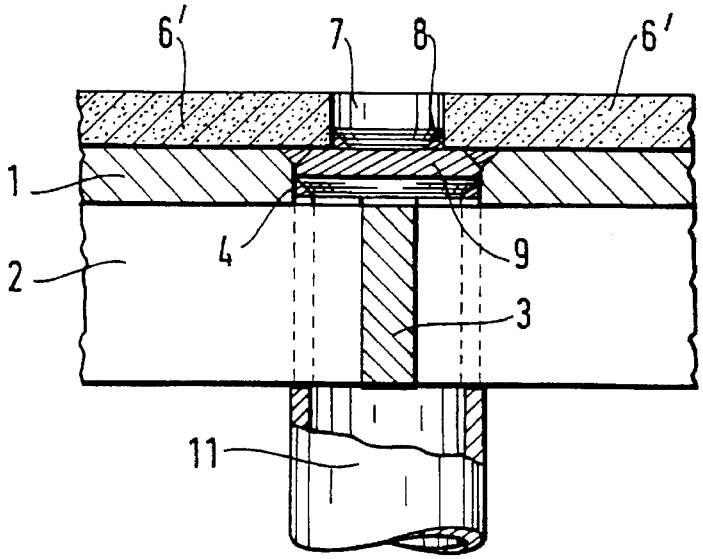
FIG. 4 is a vertical section view on IV—IV shown in FIG. 1.

The flat elements 6 are welded as shown in FIG. 3 in the factory, except for the four elements 6' which are to be disposed around each one of openings 4 in the supporting sheet 1, and which are welded on site as shown in FIG. 4.

On site, once the supporting sheet 1 equipped with flat elements 6 welded in the factory has been put into place, and the injection nozzles 10 have been installed, the four flat elements 6' are welded. A round flat piece 9 is welded in each one of the openings 4 onto a tube 11 fixed to the carrying structure 12, serving to support the sheet 1 and to prevent it from bending. For that purpose, the tube 11 is provided with passages through which the stiffening cross-pieces 2, 3, 3', 3" can pass. Flat elements 6' are welded to the round flat pieces 9 by means of welds such as 8 in the respective central openings 7 of flat elements 6'.

Flat elements 6' have their corners scalloped to a greater extent than the other flat elements 6, so that they can be inserted between the heads of the nozzles 10 that are already installed and that are of greater diameter than through holes 5.

By way of example, the length of a side of each of the square flat elements 6 may be about 240 mm, and the diameter of the central opening 7 may be about 30 mm.

Such a configuration may be used for any fluidized bed hearth floor such as the floor of a main hearth, the floor of an external fluidized bed associated with a main hearth, or the floor of a fluidized bed inside a main hearth, as described in Patent Application FR-2 690 512 filed on Apr. 27, 1992 by the Applicant.

We claim:

1. A fluidized bed hearth floor, comprising:

a supporting metal sheet of refractory metal, said sheet having a plurality of fluidization gas injection nozzles; and a coating of refractory material covering said metal sheet, said coating comprising a plurality of flat elements made of refractory metal, each flat element being welded to the supporting sheet in a localized zone.

2. A hearth floor according to claim 1, wherein the flat elements are disposed adjacent one another.

3. A hearth floor according to claim 1, wherein each flat element is provided with an opening within which the welding is performed which bonds the flat element to the supporting sheet.

4. A hearth floor according to claim 3, wherein the opening is located substantially at the center of each flat element.

5. A hearth floor according to claim 1, wherein at least some of said flat elements are substantially square.

6. A hearth floor according to claim 1, wherein at least some of said flat elements are substantially rectangular.

7. A hearth floor according to claim 6, wherein the nozzles are disposed in rows and columns, and the corners of said flat elements are scalloped to accommodate said nozzles.

8. A hearth floor according to claim 1, wherein the corners of said flat elements are scalloped to accommodate said nozzles.

9. A hearth floor according to claim 1, wherein both the supporting sheet and the flat elements are made of refractory steel.

* * * * *